US009553373B2

(12) United States Patent
Jurek et al.

(10) Patent No.: US 9,553,373 B2
(45) Date of Patent: Jan. 24, 2017

(54) ELECTRICAL SWITCHING APPARATUS AND RETENTION SYSTEM THEREFOR

(71) Applicant: Eaton Corporation, Cleveland, OH (US)

(72) Inventors: Raymond Lee Jurek, Pittsburgh, PA (US); Craig Joseph Puhalla, Moon Township, PA (US); Thomas Ted Kuzniarski, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 39 days.

(21) Appl. No.: 14/641,640

(22) Filed: Mar. 9, 2015

(65) Prior Publication Data

US 2016/0268704 A1 Sep. 15, 2016

(51) Int. Cl.
*H01R 4/28* (2006.01)
*H01H 71/10* (2006.01)

(52) U.S. Cl.
CPC ..... *H01R 4/28* (2013.01); *H01H 71/10* (2013.01)

(58) Field of Classification Search
CPC combination set(s) only.
See application file for complete search history.

(56) References Cited

U.S. PATENT DOCUMENTS 4,343,844 A 8/1982 Thayer et al.
4,849,582 A 7/1989 Stevenson
4,894,631 A 1/1990 Castonguay et al.
5,136,488 A 8/1992 McElwee
5,493,265 A 2/1996 Whipple et al.
6,388,217 B1 5/2002 Turner et al.
8,035,029 B2 * 10/2011 Mullen ..... H02G 3/088 174/50
2007/0080766 A1 4/2007 Sisley et al.
2010/0209057 A1 8/2010 Drouard
2012/0319806 A1 12/2012 Mills et al.

FOREIGN PATENT DOCUMENTS

KR 100 952 825 B1 4/2010

OTHER PUBLICATIONS

European Patent Office, "International Search Report and Written Opinion" (for corresponding application PCT/US2016/017661), May 13, 2016, 34 pp.

* cited by examiner

*Primary Examiner* — Dhirubhai R Patel
(74) *Attorney, Agent, or Firm* — Eckert Seamans; John Powers; Grant Coffield

(57) ABSTRACT

A retention system is for an electrical switching apparatus. The electrical switching apparatus includes a frame having a number of slots, a cover coupled to the frame, an electrical component enclosed by the frame and the cover, separable contacts enclosed by the frame and the cover, and an operating mechanism to open and close the separable contacts. The retention system includes: at least one bundle of wires having a plurality of individual wires extending through a corresponding one of the number of slots to be electrically connected to the electrical component; and at least one restriction mechanism each including an insulative sleeve surrounding a corresponding one of the at least one bundle of wires, and a blocking member connected to the insulative sleeve. The blocking member engages the frame to prevent undesired movement of the individual wires with respect to the corresponding one of the number of slots.

17 Claims, 4 Drawing Sheets

ELECTRICAL SWITCHING APPARATUS AND RETENTION SYSTEM THEREFOR

BACKGROUND

Field

The disclosed concept pertains generally to electrical switching apparatus, such as for example, circuit breakers. The disclosed concept also pertains to retention systems for electrical switching apparatus.

Background Information

Electrical switching apparatus are used to protect electrical circuitry from damage due to a trip condition, such as, for example, an overcurrent condition, an overload condition, an undervoltage condition, a relatively high level short circuit or fault condition, a ground fault or arc fault condition. Molded case circuit breakers, for example, include at least one pair of separable contacts which are operated either manually by way of a handle located on the outside of the case, or automatically by way of a trip unit in response to the trip condition.

Some molded case circuit breakers have wires that attach to internal components and exit the circuit breaker for use with external systems. In order for the circuit breaker to be properly certified, such as, for example and without limitation, to be properly certified by Underwriters Laboratories Inc., headquartered in Northbrook, Ill., the wiring configuration must pass a pull test. The pull test generally involves disconnecting the wires from the internal components and applying a pull force to the wires external the circuit breaker for one minute. During the test, there can be no displacement within the wire routing.

Due to advancements in technology, more features have been added internally to circuit breakers. As a result, wires having different diameters (i.e., gauges) have been employed to accommodate the internal changes. A significant drawback caused by employing the different wires is that the pull test is not always satisfied. More specifically, pull testing the different wires results in undesirable displacement of the individual wires, thereby failing the test and the ability to get the appropriate certification.

There is, therefore, room for improvement in electrical switching apparatus and in retention systems therefor.

SUMMARY

These needs and others are met by embodiments of the disclosed concept, which are directed to an electrical switching apparatus and retention system therefor, in which a restriction mechanism prevents undesired movement of individual wires.

As one aspect of the disclosed concept, a retention system for an electrical switching apparatus is provided. The electrical switching apparatus includes a frame having a number of slots, a cover coupled to the frame, an electrical component enclosed by the frame and the cover, separable contacts enclosed by the frame and the cover, and an operating mechanism to open and close the separable contacts. The retention system comprises: at least one bundle of wires comprising a plurality of individual wires structured extending through a corresponding one of the number of slots to be electrically connected to the electrical component; and at least one restriction mechanism each comprising an insulative sleeve surrounding a corresponding one of the bundle of wires, and a blocking member connected to the insulative sleeve. The blocking member is structured to engage the frame in order to prevent undesired movement of the individual wires with respect to the corresponding one of the number of slots.

As another aspect of the disclosed concept, an electrical switching apparatus is provided. The electrical switching apparatus comprises: a frame having a number of slots; a cover coupled to the frame; an electrical component enclosed by the frame and the cover; separable contacts enclosed by the frame and the cover; an operating mechanism to open and close the separable contacts; and a retention system comprising: at least one bundle of wires comprising a plurality of individual wires extending through a corresponding one of the number of slots to be electrically connected to the electrical component, and at least one restriction mechanism each comprising an insulative sleeve surrounding a corresponding one of the bundle of wires, and a blocking member connected to the insulative sleeve. The blocking member engages the frame in order to prevent undesired movement of the individual wires with respect to the corresponding one of the number of slots.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
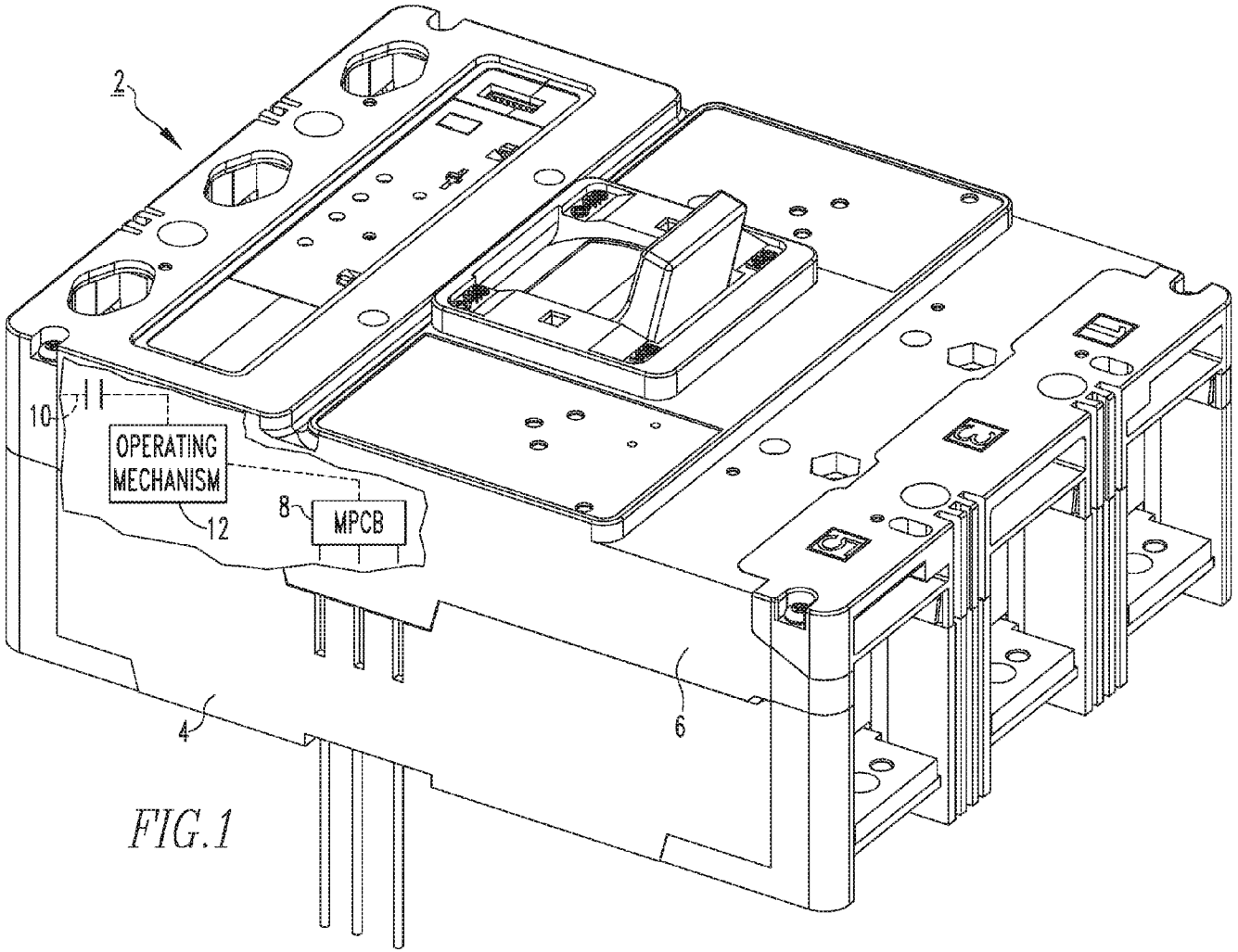
FIG. 1 is an isometric view of an electrical switching apparatus, in accordance with a non-limiting embodiment of the disclosed concept.

FIG. 1 shows an electrical switching apparatus (e.g., molded case circuit breaker 2) in accordance with a non-limiting embodiment of the disclosed concept. The example circuit breaker 2 includes a frame 4 and a cover 6 coupled to the frame 4. The circuit breaker 2 further includes an electrical component (e.g., without limitation, main printed circuit board 8, shown in simplified form) enclosed by the frame 4 and the cover 6. Also enclosed by the frame 4 and the cover 6 are a pair of separable contacts 10 (shown in simplified form) and an operating mechanism 12 (shown in simplified form) for opening and closing the separable contacts 10.

Figures 2, 3:
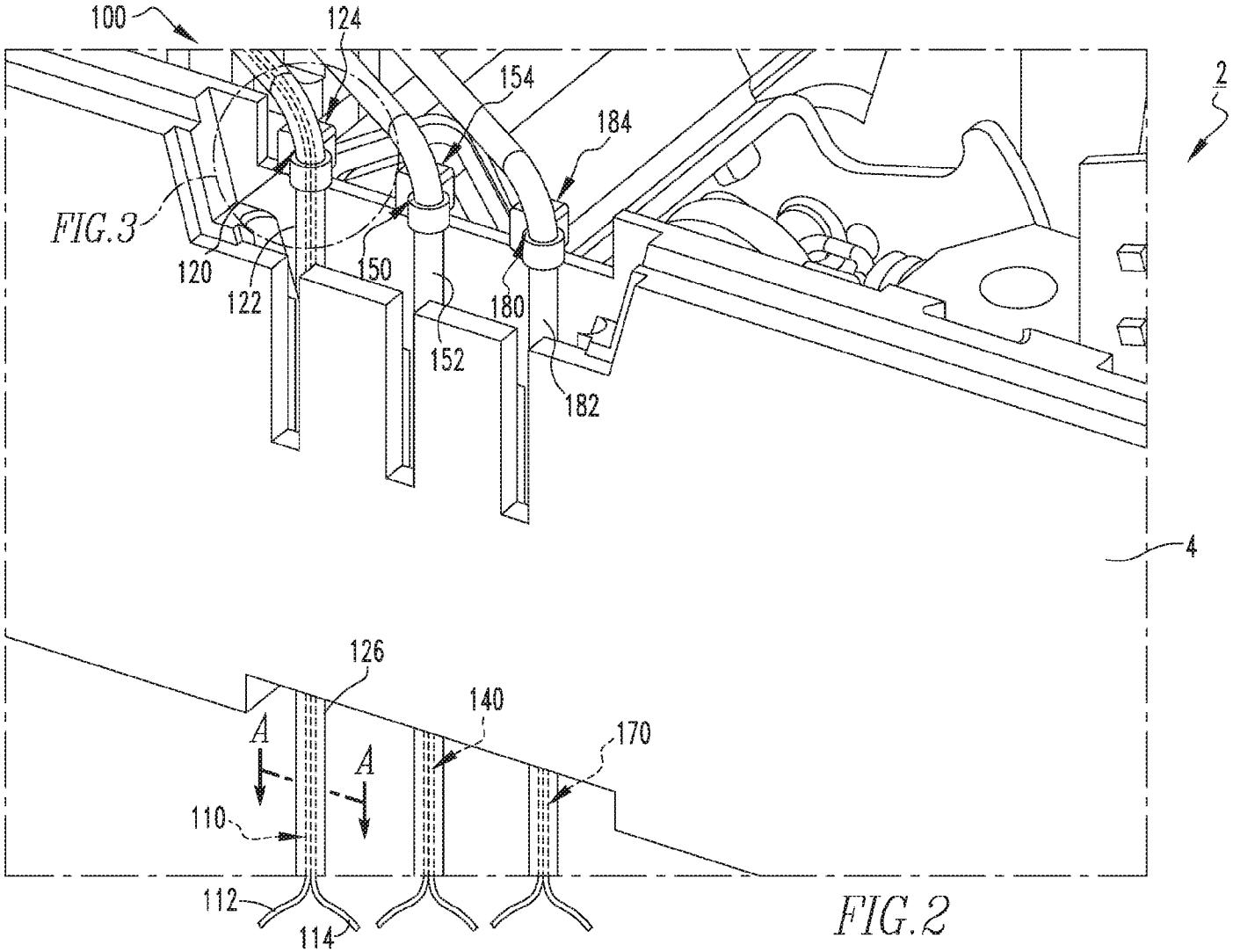
FIG. 2 is an isometric view of a portion of the electrical switching apparatus of FIG. 1, shown without the cover in order to see hidden structures.
FIG. 3 is an enlarged view of a portion of FIG. 2.
Figure 3:
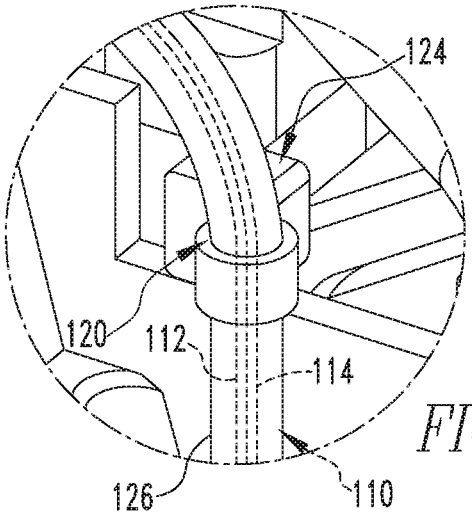

Referring to FIG. 2, the circuit breaker 2 further includes a retention system 100 located on the frame 4. The retention system 100 includes a number of bundles of wires (see, for example, three bundles of wires 110,140,170) extending through the frame 4. Each of the bundles of wires 110,140,170 has a plurality of individual wires (see, for example, individual wires 112,114, shown in hidden line drawing in FIG. 3) that are each electrically connected to the main printed circuit board 8 (FIG. 1). Although the disclosed concept is being described in association with the two individual wires 112,114, it will be appreciated that a suitable alternative bundle of wires (not shown) may also have any known number of individual wires (not shown) greater than two. The retention system 100 further includes a number of restriction mechanisms (see, for example, three restriction mechanisms 120,150,180) that advantageously prevent undesired movement of the individual wires 112,114 (and the respective individual wires of the bundles of wires 140,170) with respect to the frame 4 and with respect to each other.

Each of the respective restriction mechanisms 120,150,180 is secured to a respective one of the bundle of wires 110,140,170. The restriction mechanisms 120,150,180 each include a respective insulative sleeve (see, for example, three heat shrink tubes 122,152,182) and a respective blocking member (see, for example, three cable ties 124,154,184) connected to a respective one of the heat shrink tubes 122,152,182. Each of the respective heat shrink tubes 122,152,182 surrounds a respective one of the bundles of wires 110,140,170. When each of the respective heat shrink tubes 122,152,182 is heated, such as for example, by a heat gun, the respective heat shrink tube 122,152,182 contracts in a manner well known in the art.

Figure 4:
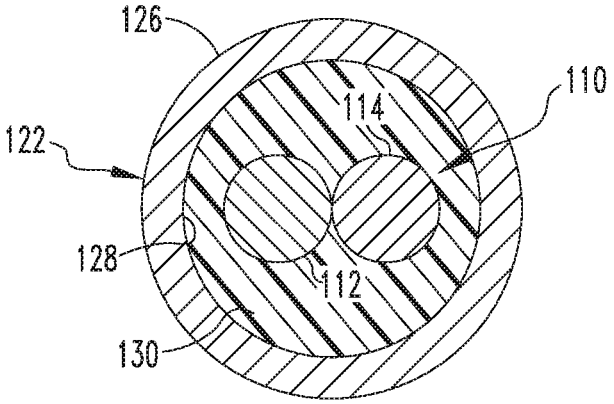
FIG. 4 is a simplified section view of a portion of the electrical switching apparatus of FIG. 2, taken along line A-A of FIG. 2.

Furthermore, each of the heat shrink tubes 122,152,182 is adhesively bonded to a respective one of the bundles of wires 110,140,170. More specifically, FIG. 4 shows a simplified section view of the bundle of wires 110 and the heat shrink tube 122. The heat shrink tube 122 includes an external portion 126 and an internal portion 128. The internal portion 128 has an adhesive coating 130 that is bonded to the bundle of wires 110. In this manner and as will be described below, during pull testing, the individual wires 112,114 (and the respective individual wires of the bundles of wires 140,170) cannot move independently with respect to the respective heat shrink tubes 122,152,182. Stated differently, the adhesive coating 130 fixes (i.e., retains) each of the individual wires 112,114 in the same position with respect to the external portion 126.

The cable tie 124 is wrapped around the external portion 126 of the heat shrink tube 122 and is fastened securely. In this manner, the cable tie 124 advantageously applies a clamp force to the heat shrink tube 122, which results in the individual wires 112,114 being clamped together. It will be appreciated that the respective cable ties 154,184 are likewise wrapped around the respective external portions of the heat shrink tubes 152,182 and are fastened securely. The cable ties 124,154,184 are each spaced from each other (i.e., the cable tie 124 is spaced from each of the cable ties 154,184, and the cable tie 154 is spaced from the cable tie 184). Moreover, the cable ties 124,154,184 are fastened securely to the respective heat shrink tubes 122,152,182 so as not to move independently with respect to the respective heat shrink tube 122,152,182 or the individual wires 112,114 (and the respective individual wires of the bundles of wires 140,170). In other words, the heat shrink tubes 122,152,182 are fixed with respect to the respective cable ties 124,154,184.

Figure 5:
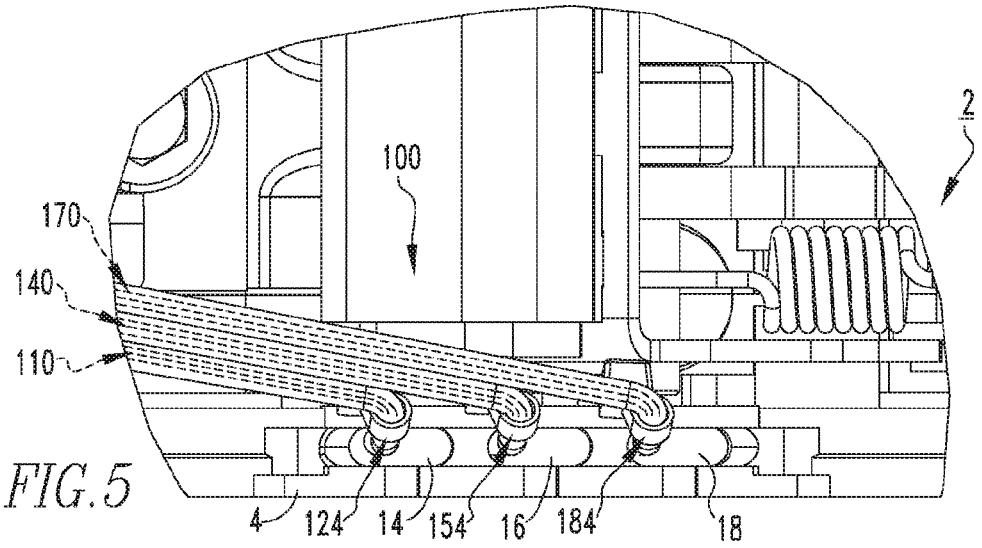
FIG. 5 is a top plan view of a portion of the electrical switching apparatus of FIG. 2.

As shown in FIG. 5, the frame 4 has a number of slots (see, for example, three individual slots 14,16,18) that are each spaced from each other (i.e., the slot 14 is spaced from the slots 16,18, and the slot 16 is spaced from the slot 18). The respective bundle of wires 110,140,170 each extend through a corresponding one of the slots 14,16,18 in order to be electrically connected to the main printed circuit board 8 (FIG. 1). Additionally, with reference to FIG. 1 and FIG. 5, it will be appreciated that the respective cable ties 124,154,184 are located on the respective bundles of wires 110,140,170 between the respective slots 14,16,18 and the main printed circuit board 8 (FIG. 1). When the cable ties 124,154,184 are fastened securely to the respective bundles of wires 110,140,170, the cable ties 124,154,184 cannot be pulled (such as for example, during pull testing) through the respective slots 14,16,18.

Figure 6:
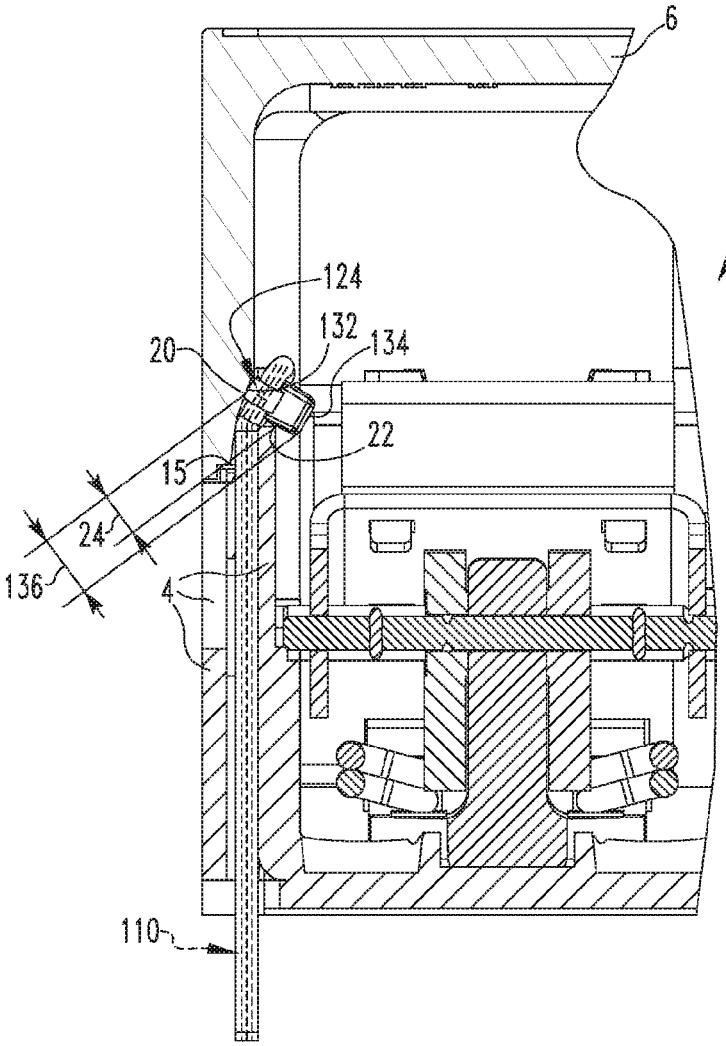
FIG. 6 is a section view of a portion of the electrical switching apparatus.

FIG. 6 shows another section view of the circuit breaker 2. As shown, the frame 4 and the cover 6 are coupled to each other at a junction 15. It will be appreciated that the cable tie 124 is located on the bundle of wires 110 between the junction 15 and the main printed circuit board 8 (FIG. 1). Similarly, it will be appreciated that the cable ties 154,184 are likewise located on the respective bundles of wires 140,170 between the junction 15 and the main printed circuit board 8 (FIG. 1). The cable tie 124 has a first distal end portion 132 and a second distal end portion 134 located opposite and distal from the first distal end portion 132. The first distal end portion 132 of the cable tie 124 engages the cover 6 at a first location 20 on the cover 6. The cable tie 124 engages the frame 4 at a second location 22 on the frame 4. The second location 22 is located between the second distal end portion 134 and the first location 20. Additionally, the first location 20 is spaced a first distance 24 from the second location 22. The first distal end portion 132 is spaced a second distance 136 from the second distal end portion 134. As shown, the second distance 136 is greater than the first distance 24.

As a result, the cable tie 124 cannot fit between (i.e., cannot be pulled through, such as for example, during pull testing) the frame 4 and the cover 6. Stated differently, when the cable tie 124 is fastened securely to the heat shrink tube 122, the size of the cable tie 124 (i.e., see for example, the distance or width 136) advantageously prevents the cable tie 124 from being pulled through the gap between the frame 4 and the cover 6 (i.e., between the first location 20 and the second location 22) through which the bundle of wires 110 extends, such as for example, during pull testing. That is, the cable tie 124 blocks or otherwise suitably prohibits undesired movement of the bundle of wires 110 and the individual wires 112,114 thereof.

Together, the heat shrink tubes 122,152,182 and the cable ties 124,154,184 advantageously prevent undesired movement of the individual wires 112,114 (and the individual wires of the bundles of wires 140,170). More specifically, during pull testing for Underwriters Laboratories Inc., headquartered in Northbrook, Ill., the individual wires 112,114 (and the individual wires of the bundles of wires 140,170) are disconnected internally from the main printed circuit board 8 (FIG. 1) and a pull force is applied to each of the individual wires 112,114 (and the individual wires of the bundles of wires 140,170) for a minimum of one minute. Referring to FIG. 5 and FIG. 6, the cable ties 124,154,184 engage the frame 4 and the cover 6 and cannot be pulled through the respective slots 14,16,18. In this manner, because each of the cable ties 124,154,184 is fastened securely to the external portion 126 (and the external portions of the respective heat shrink tubes 122,152,182), each of the heat shrink tubes 122,152,182 advantageously remains fixed with respect to the frame 4 and the cover 6 during pull testing.

Furthermore, because the heat shrink tubes 122,152,182 are adhesively bonded to the respective bundles of wires 110,140,170, and because the respective cable ties 124,154, 184 clamp the individual wires 112,114 (and the individual wires of the bundles of wires 140,170) together, the individual wires 112,114 (and the individual wires of the bundles of wires 140,170) advantageously remain fixed with respect to the respective heat shrink tubes 122,152,182 during pull testing. Thus, when a pull force is applied longitudinally to any one of the individual wires 112,114 (or the individual wires of the bundles of wires 140,170), the pull force is translated to the respective heat shrink tubes 122,152,182 as a result of the clamp force from the respective cable ties 124,154,184, and the adhesive bond (i.e., by way of the adhesive coating 130 (and the adhesive coating of the heat shrink tubes 152,182)) between the heat shrink tubes 122, 152,182 and the respective individual wires 112,114 (and the individual wires of the bundles of wires 140,170).

The pull force is further translated to respective cable ties 124,154,184 as a result of the secure connection between the cable ties 124,154,184 and the respective external portions 126 (and the external portions of the heat shrink tubes 122,152,182). However, because the cable ties 124,154,184 engage the frame 4 and the cover 6 and cannot be pulled through the frame 4 and the cover 6 (i.e., because the cable ties 124,154,184 are fixed with respect to the frame 4 and the cover 6), undesired movement (i.e., displacement) of the individual wires 112,114 (and the individual wires of the bundles of wires 110,140,170) is advantageously avoided. The restriction mechanisms 120,150,180 thus prevent longitudinal movement of the individual wires 112,114 (and the individual wires of the bundles of wires 140,170) with respect to each other and with respect to the frame 4. As a result, the pull test is advantageously able to be satisfied.

Although the disclosed concept has been described in association with the cable ties 124,154,184, it will be appreciated that a restriction mechanism (not shown) may employ any known or suitable alternative blocking member (not shown) in order to perform the desired function of fixing the respective heat shrink tubes 122,152,182 with respect to the frame 4 and the cover 6, and applying a clamp force to the individual wires 112,114 (and the respective wires of the bundles of wires 140,170). Additionally, although the disclosed concept has been described in conjunction with advantages associated with passing the pull test, it will be appreciated that other advantages, such as, for example, additional insulation provided by the heat shrink tubes 122,152,182, are also realized.

Accordingly, it will be appreciated that the disclosed concept provides for an improved (e.g., without limitation, able to pass testing requirements, relatively low cost, can be employed with existing designs without modification) electrical switching apparatus 2 and retention system 100 therefor, which prevents undesired movement of individual wires 112,114 through a frame 4 of the electrical switching apparatus 2.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A retention system for an electrical switching apparatus, said electrical switching apparatus comprising a frame having a number of slots, a cover coupled to said frame, and an electrical component coupled to said frame and said cover, said retention system comprising:

a number of bundles of wires each comprising a first wire and a second wire each structured to extend through a corresponding one of said number of slots to be electrically connected to said electrical component; and a number of restriction mechanisms each comprising an insulative sleeve and a blocking member clamped to said insulative sleeve, said insulative sleeve being bonded to said first wire and said second wire in order to prevent longitudinal movement of said first wire with respect to said second wire;

wherein said blocking member is structured to engage said frame in order to prevent undesired movement of said first wire and said second wire with respect to said corresponding one of said number of slots.

2. The retention system of claim 1 wherein said blocking member is a cable tie; and wherein said cable tie is wrapped around said insulative sleeve and fastened securely so as not to move independently with respect said insulative sleeve or said first wire or said second wire.

3. The retention system of claim 2 wherein said insulative sleeve is a heat shrink tube; wherein said heat shrink tube comprises an external portion and an internal portion; wherein said cable tie is wrapped around the external portion; wherein the internal portion has an adhesive coating; and wherein the adhesive coating is bonded to said first wire and said second wire.

4. The retention system of claim 2 wherein said number of bundles of wires comprises a first bundle of wires, a second bundle of wires, and a third bundle of wires; wherein said number of restriction mechanisms comprises a first restriction mechanism, a second restriction mechanism, and a third restriction mechanism; wherein said first restriction mechanism is secured to said first bundle of wires; wherein said second restriction mechanism is secured to said second bundle of wires; and wherein said third restriction mechanism is secured to said third bundle of wires.

5. The retention system of claim 4 wherein said first restriction mechanism comprises a first cable tie; wherein said second restriction mechanism comprises a second cable tie; wherein said third restriction mechanism comprises a third cable tie; wherein said first cable tie is spaced from each of said second cable tie and said third cable tie; and wherein said second cable tie is spaced from said third cable tie.

6. A molded case circuit breaker comprising:

a frame having a number of slots;

a cover coupled to said frame;

an electrical component coupled to said frame and said cover; and a retention system comprising:

a number of bundles of wires each comprising a first wire and a second wire each extending through a corresponding one of said number of slots to be electrically connected to said electrical component, and a number of restriction mechanisms each comprising an insulative sleeve and a blocking member clamped to said insulative sleeve, said insulative sleeve being bonded to said first wire and said second wire in order to prevent longitudinal movement of said first wire with respect to said second wire;

wherein said blocking member engages said frame in order to prevent undesired movement of said first wire and said second wire with respect to said corresponding one of said number of slots.

7. The molded case circuit breaker of claim 6 wherein said blocking member engages said cover.

8. The molded case circuit breaker of claim 7 wherein said blocking member engages said cover at a first location on said cover; wherein said blocking member engages said frame at a second location on said frame; wherein said blocking member has a first distal end portion and a second distal end portion opposite and distal the first distal end portion; wherein the first distal end portion engages the first location; and wherein the second location is disposed between the second distal end portion and the first location.

9. The molded case circuit breaker of claim 8 wherein the first location is spaced a first distance from the second location; wherein the first distal end portion is spaced a second distance from the second distal end portion; and wherein the second distance is greater than the first distance.

10. The molded case circuit breaker of claim 7 wherein said blocking member is a cable tie; and wherein said cable tie is wrapped around said insulative sleeve and fastened securely so as not to move independently with respect said insulative sleeve or said first wire or said second wire.

11. The molded case circuit breaker of claim 10 wherein said insulative sleeve is a heat shrink tube; wherein said heat shrink tube comprises an external portion and an internal portion; wherein said cable tie is wrapped around the external portion; wherein the internal portion has an adhesive coating; and wherein the adhesive coating is bonded to said first wire and said second wire.

12. The molded case circuit breaker of claim 6 wherein said cover is coupled to said frame at a junction; and wherein said blocking member is clamped to said insulative sleeve between the junction and said electrical component.

13. The molded case circuit breaker of claim 6 wherein said blocking member is clamped to said insulative sleeve between said corresponding one of said number of slots and said electrical component.

14. The molded case circuit breaker of claim 13 wherein said number of bundles of wires comprises a first bundle of wires, a second bundle of wires, and a third bundle of wires; wherein said number of slots is a first slot, a second slot, and a third slot; wherein the first slot is spaced from each of the second slot and the third slot; wherein the second slot is spaced from the third slot; wherein said first bundle of wires extends through the first slot; wherein said second bundle of wires extends through the second slot; and wherein said third bundle of wires extends through the third slot.

15. The molded case circuit breaker of claim 14 wherein said number of restriction mechanisms comprises a first restriction mechanism, a second restriction mechanism, and a third restriction mechanism; wherein said first restriction mechanism is secured to said first bundle of wires; wherein said second restriction mechanism is secured to said second bundle of wires; and wherein said third restriction mechanism is secured to said third bundle of wires.

16. The molded case circuit breaker of claim 15 wherein said first restriction mechanism comprises a first blocking member; wherein said second restriction mechanism comprises a second blocking member; wherein said third restriction mechanism comprises a third blocking member; wherein said first blocking member is spaced from each of said second blocking member and said third blocking member; and wherein said second blocking member is spaced from said third blocking member.

17. The molded case circuit breaker of claim 6 wherein said electrical component is a main printed circuit board.

* * * * *